US005940963A

United States Patent [19]

Tolmie et al.

[11] Patent Number: 5,940,963

[45] Date of Patent: Aug. 24, 1999

[54] FINISHED MASS TERMINATED END FOR A MINIATURE COAXIAL RIBBON CABLE AND METHOD OF PRODUCING SAME

[75] Inventors: Bernard R. Tolmie; Robert H. Wittemeyer, both of South Burlington, Vt.

[73] Assignee: Tensolite Company, St. Augustine, Fla.

[21] Appl. No.: 08/897,582

[22] Filed: Jul. 21, 1997

[51] Int. Cl.[6] ..... H01B 13/06

[52] U.S. Cl. ..... 29/828; 29/868; 29/878; 29/879; 29/884; 174/117 F

[58] Field of Search ..... 29/828, 868, 878, 29/879, 884; 174/117 F, 117 FF

[56] References Cited

U.S. PATENT DOCUMENTS

| | | | |
|---|---|---|---|
| 3,707,039 | 12/1972 | Niemirovich | 29/879 X |
| 3,790,737 | 2/1974 | Stoneberger et al. | 29/868 X |
| 3,994,090 | 11/1976 | Wheeler | 29/748 X |
| 4,234,756 | 11/1980 | Jackula et al. | 29/868 X |
| 4,687,264 | 8/1987 | Shuey | 29/879 X |
| 5,287,618 | 2/1994 | Koegel et al. | 29/868 X |
| 5,711,686 | 1/1998 | O'Sullivan et al. | 29/879 X |
| 5,724,730 | 3/1998 | Tanaka | 29/868 |

*Primary Examiner*—Lee W. Young
*Assistant Examiner*—Rick Kiltae Chang
*Attorney, Agent, or Firm*—Thomas N. Neiman

[57] ABSTRACT

The finished mass terminated end for a miniature coaxial ribbon cable is comprised of coaxial ribbon cable having an overlayer of metallic materials soldered into position, adhesive tape end portions and the insulation required by the conductor. The method of producing the mass terminated miniature coaxial ribbon cable comprises the steps necessary to produce a cable, both during the process and as a finished product that is consistently uniform in terms of the spacing of the conductors exposed and repetitive axial location without which later operations cannot be performed enmasse with a high degree of reliability and uniform appearance. The uniformity also allows termination without crossovers and shorts and improves strain relief by allowing all the conductors to become taut at the same time in order to equally share mechanical loads in a straight line motion.

11 Claims, 4 Drawing Sheets

FINISHED MASS TERMINATED END FOR A MINIATURE COAXIAL RIBBON CABLE AND METHOD OF PRODUCING SAME

BACKGROUND OF THE INVENTION

This invention pertains to ribbon type cables, and in particular to such a finished mass terminated end for a miniature coaxial ribbon cable and method of producing the mass terminated miniature coaxial ribbon cable for use in overcoming inherent handling and assembly problems due to the complexity of the multitude of delicate components and the difficulty of fitting them together precisely and accurately to insure a completely uniform unit.

Ribbon cables are well known in the field and the difficulties in producing those cables are well known in the industry. Since cable assemblies are subjected to wear, corrosion, abrasion vibration, thermal, pressure and other effects, they must be replaced periodically. Current construction methods of these devices requires a great deal of individual hand operations which takes time and has a significant cost and, at the same tine, results in variations from unit to unit.

It is the object of this invention, then to set forth a mass terminated miniature coaxial ribbon cable and method of producing the same which avoids the disadvantages limitations, above-recited, which obtain in prior methods for producing mass terminated miniature coaxial ribbon cable.

SUMMARY OF THE INVENTION

Particularly, it is the object of this invention to set forth a method of producing a finished mass terminated end for a miniature coaxial ribbon cable, for use in situations requiring uniformity of design in order to minimize problems caused by strain relief pressures and improve reliability and uniform appearance, comprising the steps of providing a roll of coaxial ribbon cable; inserting the coaxial ribbon cable in a carrier; providing moving drive means for the carrier; burning the outer jacket of the coaxial ribbon cable; expanding the previously burned area of the coaxial ribbon cable in order to create an exposed braid in the coaxial ribbon cable; depositing a cross section of solder around the exposed braid in the coaxial ribbon cable; providing spools of at least one metallic strip; reflowing the solder; cracking the solder as desired; removing excess material; burning the primary insulation away in the exposed area; rolling layers of adhesive tape along the line of the previous burn; cutting the adhesive tape; expanding the coaxial ribbon cable from above and below at the line of the previous burn creating a window of an exposed center conductor wire; and cutting the excessive adhesive tape forming a finished mass terminated end for the coaxial ribbon cable.

It is also the object of this invention the teach a finished mass terminated end for a miniature coaxial ribbon cable, for use in situations requiring uniformity of design in order to minimize problems caused by strain relief pressures and improve reliability and uniform appearance, comprising a plurality of coaxial conductors; said plurality of coaxial conductors having insulation surrounding them; said plurality of coaxial conductors further having an overbraid; an overlayer of metallic strips parallel to each other on top of and below said plurality of coaxial conductors; and an end portion of adhesive tape for sealing and holding said coaxial conductors in position.

BRIEF DESCRIPTION OF THE INVENTION

Further objects and features of this invention will become more apparent by reference to the following description taken in conjunction with the accompanying figures, in which.

DETAILED DESCRIPTION OF THE PREFERRED EMBODIMENTS

Figure 1:
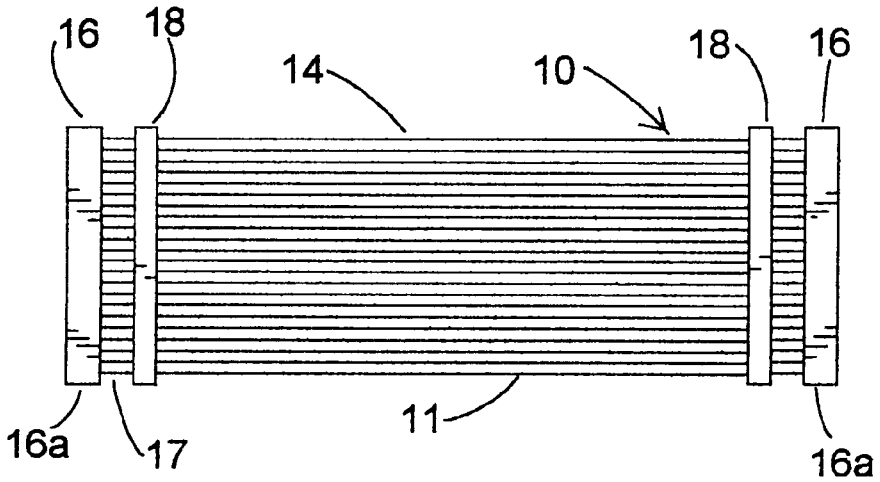
FIG. 1 is a top or bottom plan view of the finished mass terminated end for a miniature coaxial cable.
Figure 2:
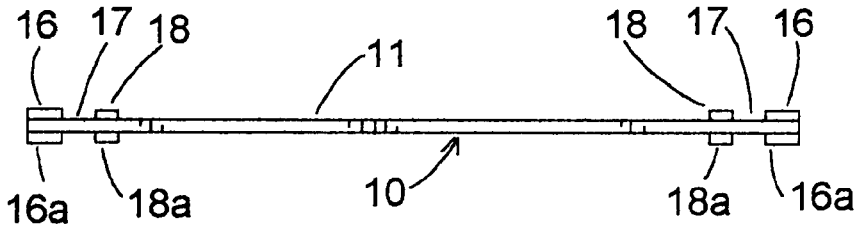
FIG. 2 is a side elevational view thereof.
Figure 3:
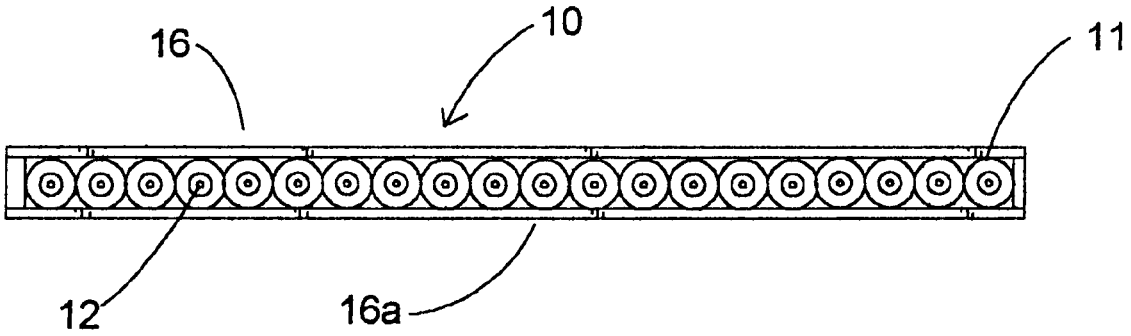
FIG. 3 is an enlarged end view thereof.
Figure 4:
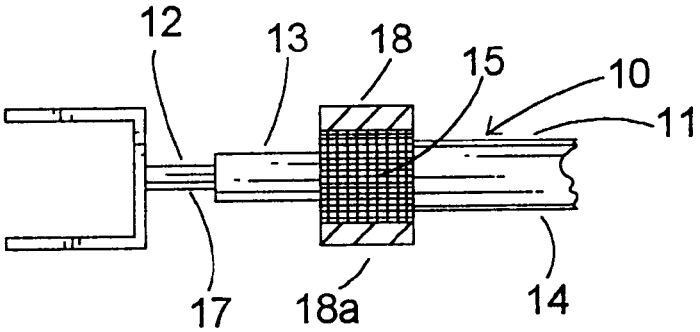
FIG. 4 is an enlarged side elevational view of the end portion of the mass terminated miniature coaxial cable.
Figure 5:
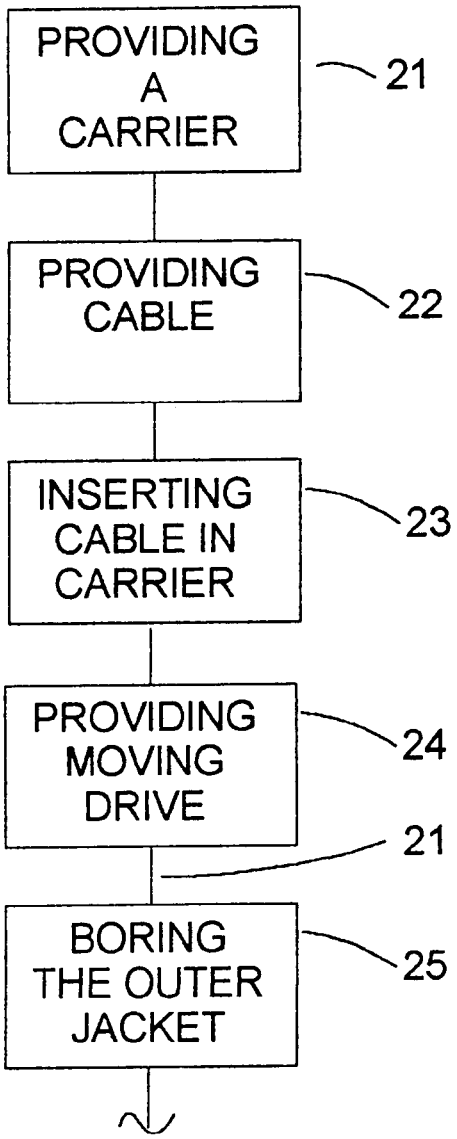
FIG. 5 is a block diagram of the process for producing the finished mass terminated end for a miniature coaxial cable.
Figure 5B:
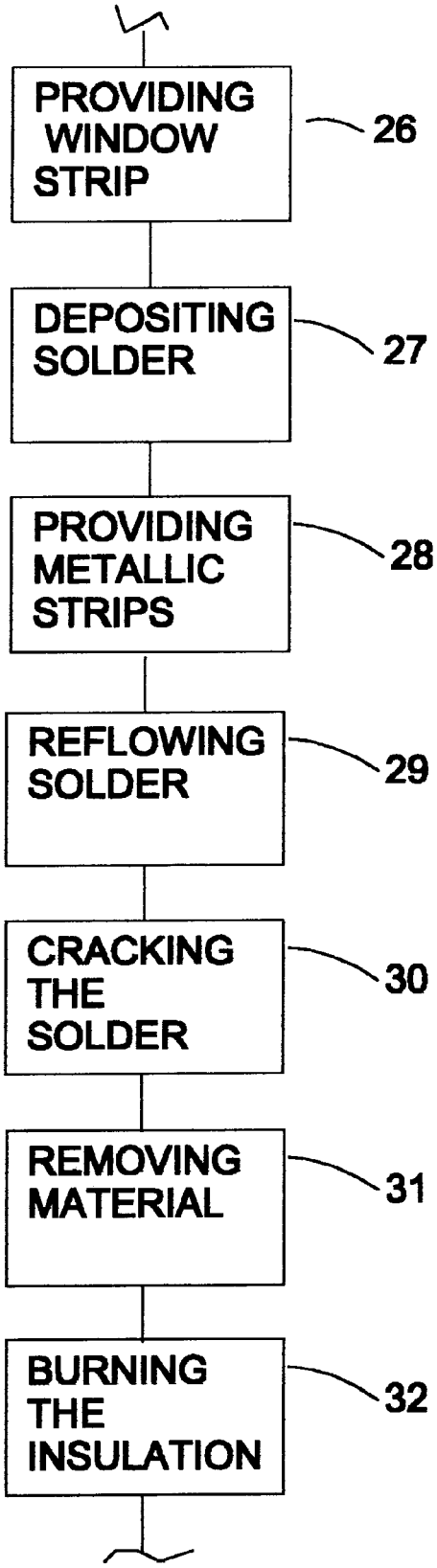
Figure 5C:
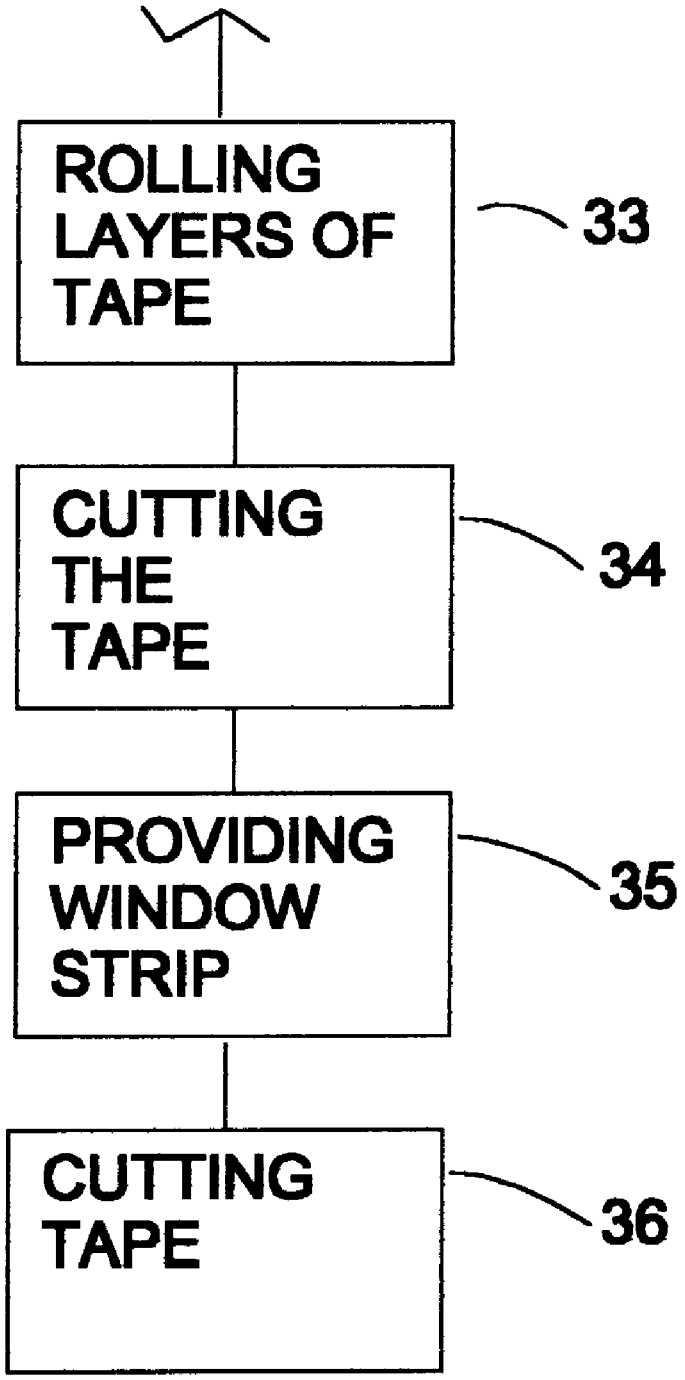

As shown in the figures, the mass terminated miniature coaxial ribbon cable 10 comprises a ribbon cable 11 having a plurality of conductors 12. The conductors 12 are surrounded with an insulation material 13 and an outer shell 14. The ribbon cable 11 has a plurality of metallic overbraids 15 which are covered top and bottom with metallic strips 18 and 18*a* that are soldered into position. Clear adhesive tape sections 16 and 16*a* are set at the ends of the ribbon cable 11 and an open area or window 17 is set between the metallic overbraid 15, metallic strips 18 and 18*a* and the clear adhesive section 16.

The method (21) of producing the finished mass terminated end for a miniature coaxial ribbon cable is designed to minimize the variations and anomalies inherent in hand operations construction of the ribbon cable. A carrier is provided which is positioned in a loading unit having target faces so that all carriers register consistently in the transverse and axial direction. The carrier can be an integral part of the timing belt assembly. The carrier is provided with a raised edge to register the coaxial ribbon cable in the transverse direction and the target face of the loading unit consistently registers the coaxial ribbon in the axial direction. The coaxial ribbon cable is provided (22) and the coaxial ribbon is then clamped (23) to the carrier to prevent independent motion with respect to the carrier. The carrier is positioned on an timing belt (24) in predetermined positions on the belt as needed for the particular end product desired. The speed of the belt is also determined by the end product desired. The carrier on the belt is then passed by two sets of opposing laser beams which burn through the top and bottom of the outer material (25) of the coaxial ribbon cable to the overbraid of each coaxial wire in a thin line. The progression of the timing belt moves the coaxial ribbon cable to a cam actuated blade station having upper and lower blades which come together (26) to a predetermined gap at the point on the coaxial ribbon cable that the laser burn had been made. This action creates the exposed window of braids in the coaxial ribbon cable. The blades then retract to await the next cutting point. This total operation can be performed on a single end or both ends of the cable at the same time.

The timing belt then carries the coaxial ribbon cable to an adjustable flow solder paste extruder which deposits a rectangular cross section of solder paste (27) across the exposed braid of the coaxial ribbon cable. The carrier with the coaxial ribbon cable is then transferred to a start and stop belt and passes a pair of dual head solder reflow stations. The spools of metallic overbraid move so as to present two parallel configuration sets of the metallic strips above and below the coaxial ribbon cable (28) in line with the exposed braid and the far edge of the solder paste. The thermodes, one above and one below the coaxial ribbon cable, then come together sandwiching the coaxial ribbon conductor wire and solder paste and upper and lower metallic strips and they heat and flow the solder (29) thus encapsulating the metallic overbraids and conductors and affixing the center to center spacing of the individual overbraids.

The belt then carries the ribbon cable to the solder cracking station (30) that captures the metallic overstrips between upper and lower clamps. The outermost metallic strips are captured between upper and lower clamps which initiate an up and down pivot motion to crack the solder and break the solder enclosed overbraid at the break line. The carrier advances to a parallel blade station that come together at the break line and retract to pull the freed solder and braids off the coaxial ribbon cable (31) exposing the primary insulation of the center conducts.

The carrier then passed by two sets of laser beams and the primary insulation of the center conductors is burned away (32) in a thin line. The carrier moves to a taping section having an upper and lower roll of adhesive tape coming together between opposing rollers forming a vertex in the tape (33) between which the coaxial ribbon cable will advance. The tape is positioned on the top and the bottom at the laser cut line and then is cut by means of a guillotine cutter (34). The carrier then progresses to a cam actuated blade station having an upper and lower blade coming together as the carrier progresses in line with the previous laser cut and then retract a fixed distance creating a window of exposed center conductor wire in the coaxial ribbon cable (35). The adhesive tape is trimmed into a final finished product by means of guillotine blades completing one or both ends of the mass terminated miniature coaxial cable (36).

While we have described our invention in connection with specific embodiments thereof, it is clearly to be understood that this is done only by way of example and not as a limitation to the scope of our invention as set forth in the objects thereof and in the appended claims.

We claim:

1. A method of producing a finished mass terminated end for a miniature coaxial cable, for use in situations requiring uniformity of design in order to minimize problems caused by strain relief pressures and improve reliability and uniform appearance, comprising the steps of:

providing a roll of coaxial ribbon cable comprising a ribbon cable having a plurality of conductors surrounded by insulation material and an outer jacket;

inserting the coaxial ribbon cable in a carrier;

providing moving drive means for the carrier;

burning the outer jacket of the coaxial ribbon cable;

expanding area around the burned outer jacket of the coaxial ribbon cable in order to create an exposed braid in the coaxial ribbon cable;

depositing a cross section of solder around the exposed braid in the coaxial ribbon cable;

providing spools of at least one metallic strip reflowing the solder;

cracking the solder to loosen excess solder;

removing excess solder;

burning the insulation material away in the exposed braid in the coaxial ribbon cable;

rolling layers of adhesive tape along the area around the burned outer jacket of the coaxial ribbon cable;

cutting the adhesive tape;

expanding the coaxial ribbon cable from above and below at the exposed braid in the coaxial ribbon cable creating a window of an exposed center conductor wire; and cutting excess adhesive tape with cutting means forming a finished mass terminated end for the coaxial ribbon cable.

2. The method of producing a finished mass terminated end for a miniature coaxial ribbon cable, according to claim 1, wherein:

said inserting the coaxial ribbon cable in a carrier step comprises clamping the cable in a carrier.

3. The method of producing a finished mass terminated end for a miniature coaxial ribbon cable, according to claim 1, wherein:

said providing moving drive means step comprises providing primary means comprising a timing belt having adjustable carrier attachment points in order to provide consistent placement of a carrier and coaxial ribbon cable, and secondary means comprising a stop and start belt having adjustable carrier attachment points.

4. The method of producing a finished mass terminated end for a miniature coaxial ribbon cable, according to claim 1, wherein:

said burning the outer jacket of the coaxial ribbon cable step comprises using a laser beam to accomplish burning the outer jacket.

5. The method of producing a mass terminated end for a miniature coaxial ribbon cable, according to claim 1, wherein:

said expanding the area around the burned outer jacket step comprises using a cam actuated adjustable blade unit having upper and lower blades.

6. The method of producing a finished mass terminated end for a miniature coaxial ribbon cable, according to claim 1, wherein:

said cracking the solder step comprises capturing metallic strips between upper and lower clamps; and said cracking the solder step further comprises using an up and down pivot motion in order to crack the solder and break the solder enclosed braids at a break line, thus freeing the excess solder and braids at the break line.

7. The method of producing a finished mass terminated end for a miniature coaxial ribbon cable, according to claim 1, wherein:

said removing excess solder and said creating said exposed braids step comprises use of parallel blade stations.

8. The method of producing a finished mass terminated end for a miniature coaxial ribbon cable according to claim 1, wherein:

said burning the insulation material step comprises use of laser beams.

9. The method of producing a finished mass terminated end for a miniature coaxial ribbon cable, according to claim 1, wherein:

said rolling layers of the adhesive tape step comprises use of upper and lower rolls of adhesive tape between rollers in order to affix the tape on top and bottom of the area around the burned outer jacket of the coaxial ribbon cable.

10. The method of producing a finished mass terminated miniature coaxial ribbon cable, according to claim 1, wherein:

said cutting the excess adhesive tape with cutting means step comprises use of guillotine cutter.

11. A method of producing a finished mass terminated end for a miniature coaxial ribbon cable, according to claim 1, wherein:

said cutting the excess adhesive tape step comprises the use of a guillotine cutter.

* * * * *